US010931059B1

(12) United States Patent
Kellogg et al.

(10) Patent No.: US 10,931,059 B1
(45) Date of Patent: Feb. 23, 2021

(54) HERMETIC EDGE-CONNECT HEADERS AND CORRESPONDING CONNECTORS

(71) Applicant: National Technology & Engineering Solutions of Sandia, LLC, Albuquerque, NM (US)

(72) Inventors: Rick A. Kellogg, Albuquerque, NM (US); Bradley C. Salzbrenner, Albuquerque, NM (US); Charles A. Walker, Albuquerque, NM (US); Michael E. McReaken, Albuquerque, NM (US); Marshall S. Klee, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 16/559,130

(22) Filed: Sep. 3, 2019

(51) Int. Cl.

| | |
|---|---|
| ***H01R 13/52*** | (2006.01) |
| ***H01R 13/26*** | (2006.01) |
| ***H01R 13/502*** | (2006.01) |
| ***H01R 24/60*** | (2011.01) |
| ***H01R 13/10*** | (2006.01) |
| *H01R 107/00* | (2006.01) |
| *H01R 13/523* | (2006.01) |

(52) U.S. Cl.
CPC ..... *H01R 13/521* (2013.01); *H01R 13/10* (2013.01); *H01R 13/26* (2013.01); *H01R 13/502* (2013.01); *H01R 13/5202* (2013.01); *H01R 24/60* (2013.01); *H01R 13/523* (2013.01); *H01R 13/5219* (2013.01); *H01R 2107/00* (2013.01); *Y10T 29/49002* (2015.01); *Y10T 29/49204* (2015.01)

(58) Field of Classification Search
CPC ..... H01R 13/521; H01R 13/10; H01R 24/60; H01R 13/5202; H01R 13/26; H01R 13/502; H01R 13/523; H01R 13/5219; H01R 2107/00; Y10T 29/49002; Y10T 29/49204; Y10T 29/4911
See application file for complete search history.

(56) References Cited

U.S. PATENT DOCUMENTS

| | | | | |
|---|---|---|---|---|
| 9,065,224 | B2 * | 6/2015 | Marzano | H01R 13/5224 |
| 2016/0013581 | A1 * | 1/2016 | Wu | H01R 13/5845 439/452 |

* cited by examiner

*Primary Examiner* — Abdullah A Riyami
*Assistant Examiner* — Justin M Kratt
(74) *Attorney, Agent, or Firm* — Mark A. Dodd

(57) ABSTRACT

A hermetically-sealed edge-connect header that can withstand high temperatures, high pressures (or high vacuum levels), and high vibration environments, along with two corresponding connectors are disclosed. After brazing the edge-connect header components, the assembly is machined to form a slot with a portion of each of a plurality of electrical conductors removed in the machining process, resulting in a header with a high pin density. During the process of mating the first connector design to the edge-connect header, a plurality of wipers in the connector deflect, thereby causing the wipers to extend from the connector and contact the corresponding electrical conductors in the header. During the process of mating the second connector design to the edge-connect header, each of a plurality of wipers formed of low-mass, compliant metal wool, forms multiple contact points with a corresponding electrical conductor in the header.

5 Claims, 13 Drawing Sheets

HERMETIC EDGE-CONNECT HEADERS AND CORRESPONDING CONNECTORS

STATEMENT OF GOVERNMENT INTEREST

This invention was made with Government support under Contract No. DE-NA0003525 awarded by the United States Department of Energy/National Nuclear Security Administration. The Government has certain rights in the invention.

TECHNICAL FIELD

The present invention relates to hermetically-sealed edge-connect electrical headers that can withstand high temperatures (700° C.), high pressure (for a factor of safety of 2, withstands >400 atm to 200° C., >385 atm to 300° C., >260 atm to 500° C., >170 atm to 600° C. and >60 atm to 700° C.), high vacuum (helium leak rates $<10^{-11}$ atm·cc/sec), as well as a high-reliability connector mating/de-mating edge-connect configuration and corresponding low-wear, low-chatter, and low-profile connectors.

BACKGROUND

Numerous applications require hermetic electrical headers that can withstand temperature cycling, high temperatures, high pressures (or high vacuum levels) with low leak rates and are robust to mechanical environments including high-count connector mating/de-mating cycles, vibration, and mechanical shock. In the past, hermetic electrical headers have employed a ceramic core with brazed-in metal pins, or a metallic shell with glass or glass/ceramic-based sealing of the pins. These prior hermetic electrical feedthrough technologies suffer from several potential shortcomings.

Prior art hermetic brazed-ceramic headers (with pins brazed into a ceramic core) employ cantilevered pins that extend beyond either face of the ceramic core. These unsupported pins provide an electrical socket-based connector interface; however, the pins may be subject to bending during the mating/de-mating process with the potential for damaging the hermetic seal. Blind connector mating/de-mating can be problematic and visual inspection for bent pins (while the connector is mated) is impossible. Further, these header pins and their corresponding sockets may be worn if the connector is to be repeatedly mated and de-mated, resulting in degraded electrical performance over time.

Prior art glass or glass/ceramic-based multi-pin headers often have a limited upper operating temperature in the range of 250° C. This is due to softening of the glass and a substantial decrease in structural performance (i.e., the ability to withstand high pressure or vacuum with low leak rates), as well as an orders-of-magnitude reduction in the electrical resistivity (i.e., electrical isolation). As certain applications operate at temperatures greater than 250° C., these glass or glass/ceramic-based multi-pin headers must be cooled. Consequently, while many of these glass or glass/ceramic-based multi-pin headers can handle ultra-high vacuum levels, for example, $10^{-10}$ Torr (with helium leak rates $<10^{-10}$ atm·cc/sec), they do not readily handle the high-pressure levels at the elevated temperatures required for certain applications.

The glass or glass/ceramic-based hermetic multi-pin headers have very modest pin pitches and corresponding pin densities, resulting in very large headers when an application requires a high pin count. In addition, many glass or glass/ceramic-based multi-pin headers employ unsupported pins.

These unsupported pins are susceptible to being bent during the mating process, making blind mating (or de-mating) problematic. Further, these unsupported pins and their corresponding sockets may be worn if the multi-pin header/connector is to be repeatedly mated and de-mated, resulting in degraded electrical performance over time.

The brazed-ceramic and glass or glass/ceramic-based hermetic multi-pin headers, with mating connectors, can suffer from electrical chatter in high vibration environments, leading to high noise levels in the corresponding transmitted signals. This is due to the connector sockets/wipers interaction with unsupported header pins. Although higher electrical contact loading will reduce chatter, the loading is constrained by material strength/stiffness and wear limitations of both the header pins and the connector sockets/wipers.

Thus, the need exists for rugged and durable hermetically-sealed edge-connect headers that can withstand high temperatures, high pressures (or high vacuum levels), and high vibration environments and corresponding connectors.

SUMMARY

One aspect of the present invention relates to a hermetically-sealed edge-connect header that can withstand high temperatures, high pressures (or high vacuum levels), and high vibration environments. Another aspect of the present invention relates to two corresponding connector designs where the supported header pins are loaded 1) by the connector wipers upon the final stage of mating or 2) through a low-mass, compliant metal wool (filamentous mass) to reduce electrical chatter and wear during repeated mating and de-mating.

In at least one embodiment of the present invention, a hermetically-sealed edge-connect header comprises a shell, a core, a plurality of electrical conductors (e.g., pins), and braze filler. After brazing, the assembly is machined to form a slot with a portion of the core and a portion of each of the plurality of electrical conductors removed in the machining process. Due to the advanced fabrication process, the pin density of this embodiment of the present invention may be a factor 3, or more, greater than that found in the prior art for glass or glass/ceramic-based hermetic multi-pin headers.

In various embodiments of the present invention: the slot in the hermetically-sealed edge-connect header is a linear slot with some of the plurality of electrical conductors on one side of the slot while others of the plurality of electrical conductors are on the opposite side of the slot; the slot in the hermetically-sealed edge-connect header is a ring-shaped slot forming a central boss with some of the plurality of electrical conductors on one side of the boss while others of the plurality of electrical conductors are on the opposite side of the boss; the slot in the hermetically-sealed edge-connect header is a ring-shaped slot forming a central boss with some of the plurality of electrical conductors on the inner perimeter of the ring-shaped slot while others of the plurality of electrical conductors are on the outer perimeter of the ring-shaped slot; and the hermetically-sealed edge-connect header includes at least two slots.

In at least one embodiment of the present invention, a connector comprises a shell, a plurality of wipers, a wiper housing, and a shuttle. During the process of mating the connector to the edge-connect header, the plurality of wipers extend out of the shuttle.

In various embodiments of the present invention: the wipers extend out of the shuttle in a direction orthogonal to the direction of the motion of the connector when mating with a corresponding edge-connect header; the shuttle is adapted to partially retract into the shell, and the engagement profiles cause the wipers to extend out of the shuttle due to the motion of the tips of the wipers along the engagement profiles when the shuttle partially retracts into the shell; the connector includes a spring adapted to compress when the shuttle partially retracts into the shell; the location of the shuttle is fixed with respect to the shell, the tips of the wipers retract into the face of the shuttle, and the engagement profiles cause a portion of each of the wipers to extend out of the shuttle due to motion of the wipers along the engagement profiles when the tips of the wipers retract into the face of the shuttle; the portion of the wipers that extends out of the shuttle has a curved shape or a flat cross-sectional shape; the pin housing and the pin shuttle have a linear shape, a ring shape, an arc shape, a circular shape, or a U shape; the wiper housing and the shuttle have a ring shape, with some of the plurality of wipers are adapted to extend out of the ring-shaped shuttle in a direction toward an inner perimeter of the ring-shaped shuttle, while others of the plurality of wipers are adapted to extend out of the ring-shaped shuttle in a direction toward an outer perimeter of the ring-shaped shuttle; and the connector includes a second wiper housing, a second plurality of wipers, and a second shuttle.

In yet another embodiment of the present invention, a connector comprises a faceplate having a boss, a plurality of pins, a corresponding plurality of wipers, and a backing plate. Each of the wipers is formed of a low-mass, compliant metal wool such that the wipers in the connector contact the corresponding electrical conductors in the edge-connect header throughout the mating and de-mating process. Due to the compressibility of the low-mass, compliant metal wool-based wipers, each wiper contacts the corresponding conductor in the edge-connect header at multiple points ensuring contact even in high vibration environments, thereby reducing electrical chatter.

In various embodiments of the present invention: the connector includes a multi-conductor cable in electrical contact with the plurality of pins with the backing plate adapted to fixedly locate the multi-conductor cable; the connector includes a socket in electrical contact with the plurality of pins and adapted to electrically connect to a multi-conductor cable; the boss has a linear shape, a ring shape, an arc shape, a circular shape, or a U shape; the boss has a ring shape with some of the wipers located adjacent an inner perimeter of the ring-shaped boss while other wipers are located adjacent an outer perimeter of the ring-shaped boss; and the connector includes a second plurality of pins and a second plurality of wipers, while the faceplate includes a second boss.

Both connector designs provide support for their corresponding wipers, thus making them less susceptible to bending compared to prior art connector designs. For this reason, both connector designs are robust candidates for applications requiring blind connector mating or de-mating.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings. The drawings are not to scale and are intended only to illustrate the elements of various embodiments of the present invention.

DETAILED DESCRIPTION

Figure 1A:
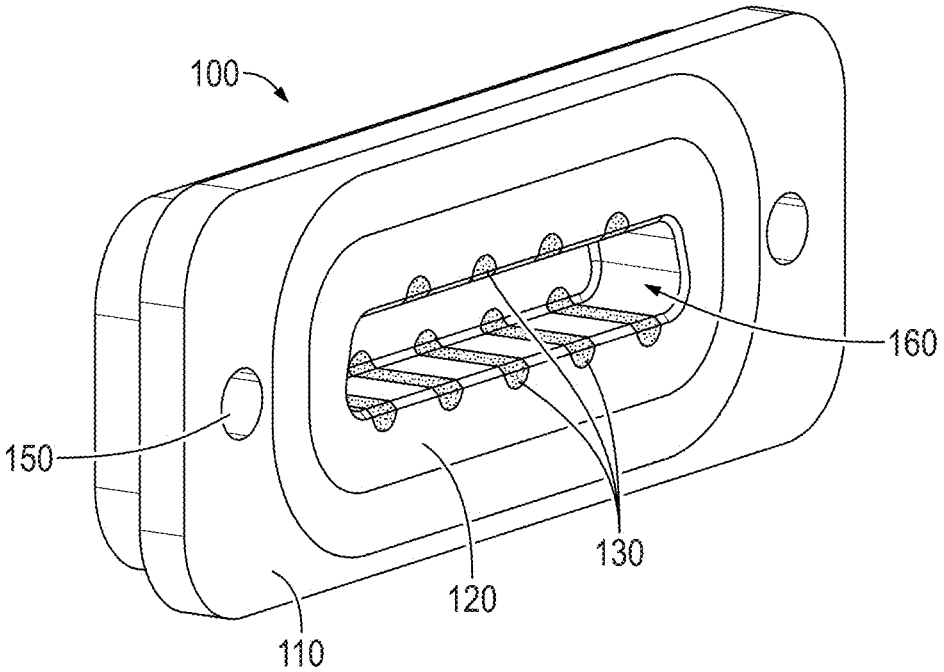
FIG. 1A illustrates a three-dimensional (3D) view of a hermetically-sealed edge-connect header in accordance with one or more embodiments of the present invention.

FIG. 1A illustrates a three-dimensional (3D) view of a hermetically-sealed edge-connect header 100 in accordance with at least one embodiment of the present invention. The edge-connect header 100 includes a shell 110, a core 120, a plurality of electrical conductors 130, a braze filler 140 in the joints between the shell 110 and the core 120 and in the joints between the core 120 and the electrical conductors 130 (shown more clearly in FIG. 1B), and two attachment openings 150, for example threaded screw holes, located in the perimeter of the shell 110 for securing a corresponding connector (not shown). The edge-connect header 100 further includes a linear slot 160 formed by machining a portion of the core 120 and a portion of each of the electrical conductors 130. As shown in FIG. 1A, a first set of the electrical conductors 130 are located adjacent a first side of the linear slot 160, while a second set of the electrical conductors 130 are located adjacent a second side of the linear slot 160 facing the first side of the linear slot 160.

Figure 1B:
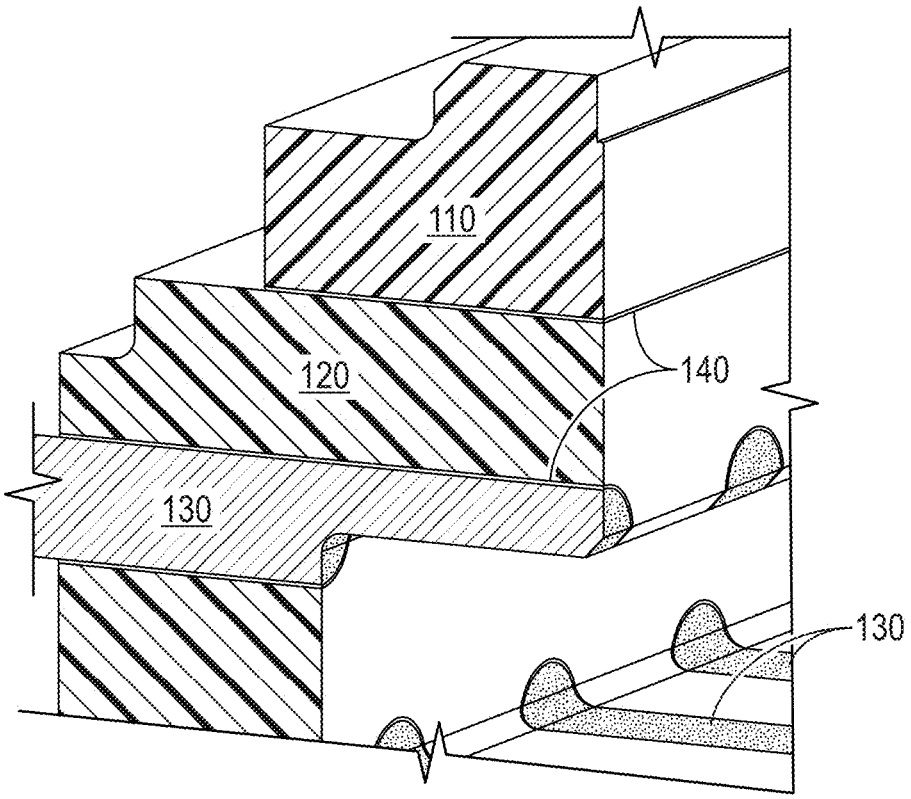
FIG. 1B illustrates a cross-sectional 3D view of the hermetically-sealed edge-connect header.
Figure 1C:
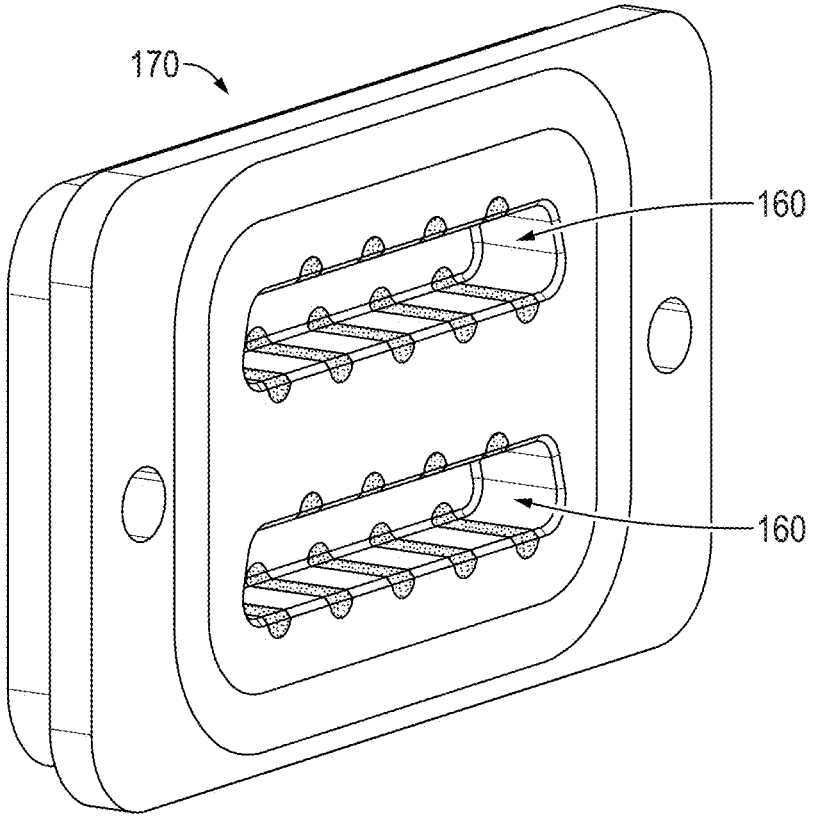
FIG. 1C illustrates a 3D view of an alternative hermetically-sealed edge-connect header in accordance with one or more embodiments of the present invention.

While the edge-connect header 100 shown in FIGS. 1A-1B has a single linear slot 160, in other embodiments of the present invention, such as that shown in FIG. 1C, the edge-connect header 170 may have more than one linear slot 160. For example, when an application requires many electrical conductors 130, the use of a single linear slot 160 may result in an edge-connect header 100 that has a very wide (or long) form factor. If the application requires a smaller form factor, two (or more) linear slots 160 may be employed.

While the edge-connect header 100 shown in FIGS. 1A-1B has a linear slot 160, in other embodiments of the present invention (not shown), the edge-connect header may have a curved slot forming an arc or a U-shape. Electrical conductors can be located on both or either face of the curved slot. The core and shell may have a circular shape concentric with the slot to maximize volumetric efficiency.

In still other embodiments of the present invention (not shown), the slot 160 has a ring shape, thereby forming a central boss. In this embodiment, a first set of the electrical conductors 130 are located around the perimeter of this central boss, i.e., around the inner perimeter of the ring-shaped slot 160, while a second set of the electrical conductors 130 are located around the outer perimeter of the ring-shaped slot 160. As with the embodiment illustrated in FIG. 1C, this embodiment with electrical conductors 130 located around both the inner and outer perimeter of the ring-shaped slot 160 may find use in applications requiring many electrical conductors 130.

Figure 2A:
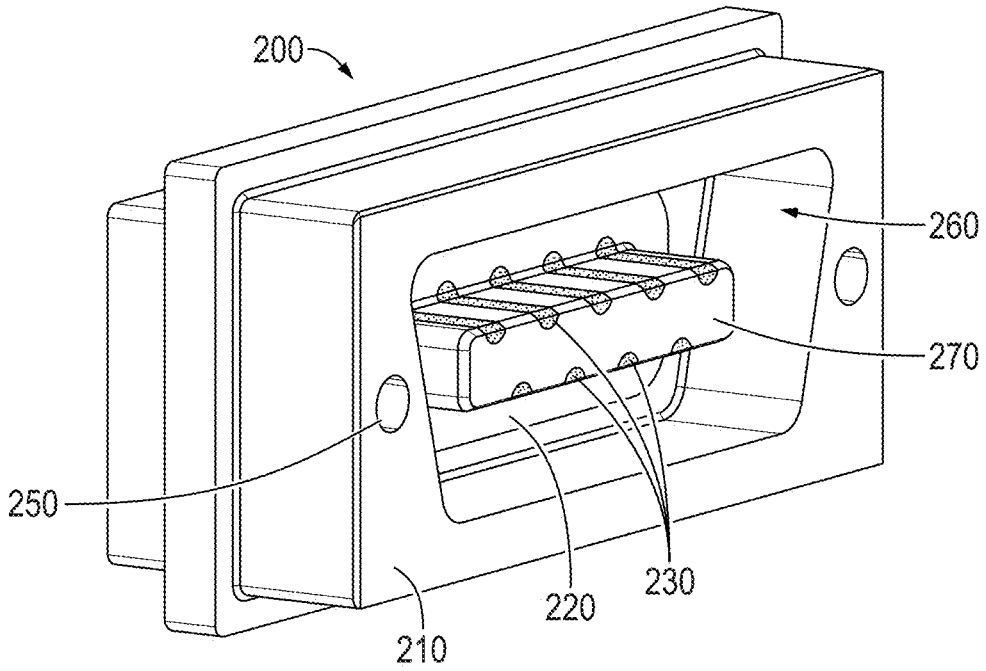
FIG. 2A illustrates a 3D view of a hermetically-sealed edge-connect header in accordance with at least one other embodiment of the present invention.

FIG. 2A illustrates a hermetically-sealed edge-connect header 200 in accordance with at least one embodiment of the present invention. The edge-connect header 200 illustrated in FIG. 2A is similar to the edge-connect header 100 illustrated in FIG. 1, but with the electrical conductors 230 exposed to a ring-shaped slot 260 produced in the core 220 after machining. In the edge-connect header 100 illustrated in FIG. 1, the machining process created a linear slot 160 with the machined electrical conductors 130 facing inward toward the linear slot 160. In the edge-connect header 200 illustrated in FIG. 2A, the machining of the core 220 left a boss 270, with the machined electrical conductors 230 facing outward toward the ring-shaped slot 260. As shown in FIG. 2A, a first set of the electrical conductors 230 are located adjacent to a first side of the boss 270, while a second set of the electrical conductors 230 are located adjacent to a second side of the boss 270 opposite the first side of the boss 270. The remaining elements of the edge-connect header 200 correspond to those of the edge-connect header 100, including a shell 210, a core 220, a braze filler (not shown), and threaded screw holes 250.

Figure 2B:
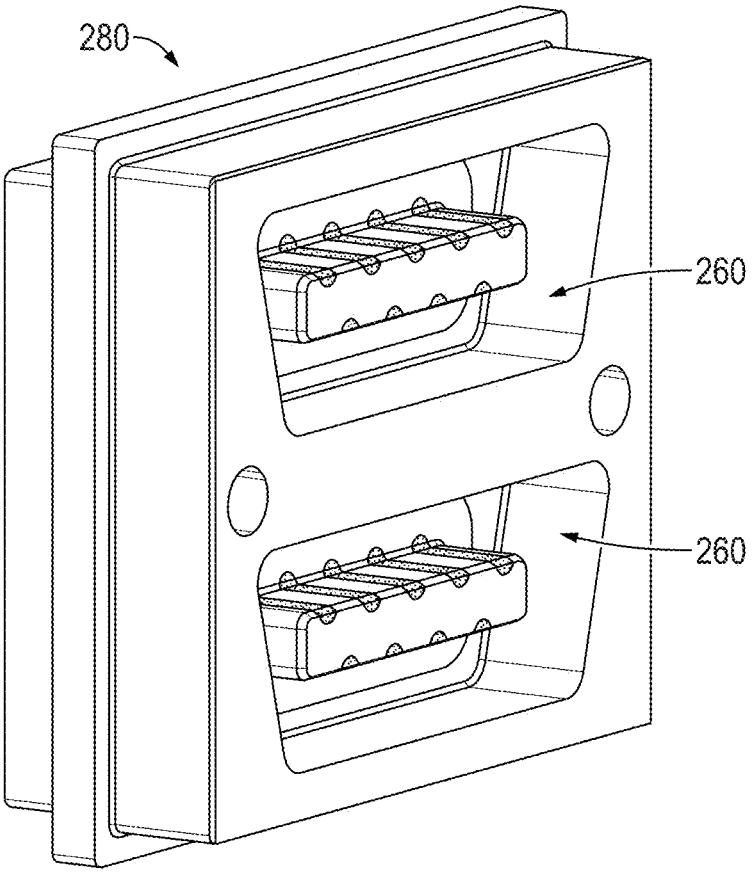
FIG. 2B illustrates a 3D view of an alternative hermetically-sealed edge-connect header in accordance with one or more embodiments of the present invention.

While the edge-connect header 200 shown in FIG. 2A has a single ring-shaped slot 260, other embodiments of the present invention, such as that shown in FIG. 2B, have an edge-connect header 280 with more than one ring-shaped slot 260. For example, when an application requires many electrical conductors 230, the use of a single ring-shaped slot 260 may result in an edge-connect header 200 that has a very wide (or long) form factor. If the application requires a smaller form factor, two (or more) ring-shaped slots 260 may be employed.

While the edge-connect header 200 shown in FIG. 2A has an elongated ring-shaped slot 260, in other embodiments of the present invention (not shown), the edge-connect header may have a have a round ring-shaped slot. Electrical conductors would be located around the inner perimeter of the round ring-shaped slot. The core and shell may have a circular shape concentric with the slot to maximize volumetric efficiency. The core or shell may have a key to ensure mating to a corresponding connector in only a single orientation, thereby ensuring that the electrical conductors of the edge-connect header are in electrical contact with the correct pins in the corresponding connector.

While the edge-connect header 100 shown in FIG. 1A has a linear slot 160 with trapezoidal end geometry, other embodiments of the present invention have an edge-connect header with a U-shaped slot. An edge-connect header having either trapezoidal end geometry or a U-shaped slot provides the benefit of mating to a corresponding connector in only a single orientation, thereby ensuring that the electrical conductors 130 of the edge-connect header are in electrical contact with the correct pins in the corresponding connector. Further, in some embodiments of the present invention, the electrical conductors 130 may be located around just the inner perimeter (or outer perimeter) of the U-shaped slot. In other embodiments of the present invention, a first set of the electrical conductors 230 are located around the inner perimeter of the U-shaped slot, while a second set of the electrical conductors 230 are located around the outer perimeter of the U-shaped slot. As will be appreciated, an edge-connect header may include a combination of one or more linear slots 160 with trapezoidal end geometry, one or more ring-shaped slots 260, and/or one or more U-shaped slots.

Figure 3A:
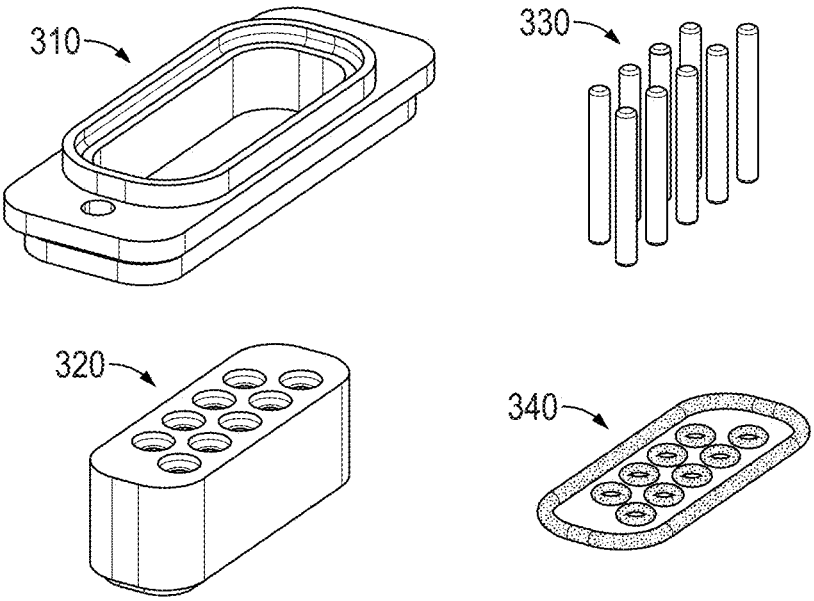
FIGS. 3A-3D illustrate the fabrication sequence for manufacturing a hermetic edge-connect header in accordance with one or more embodiments of the present invention.
Figure 3B:
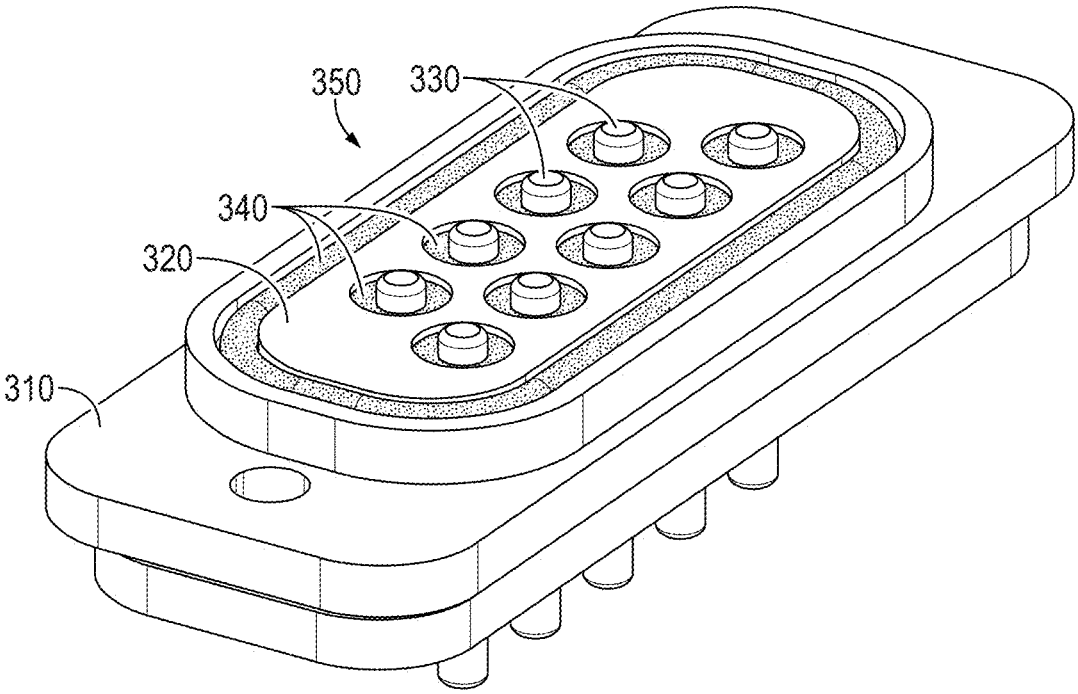
Figure 3C:
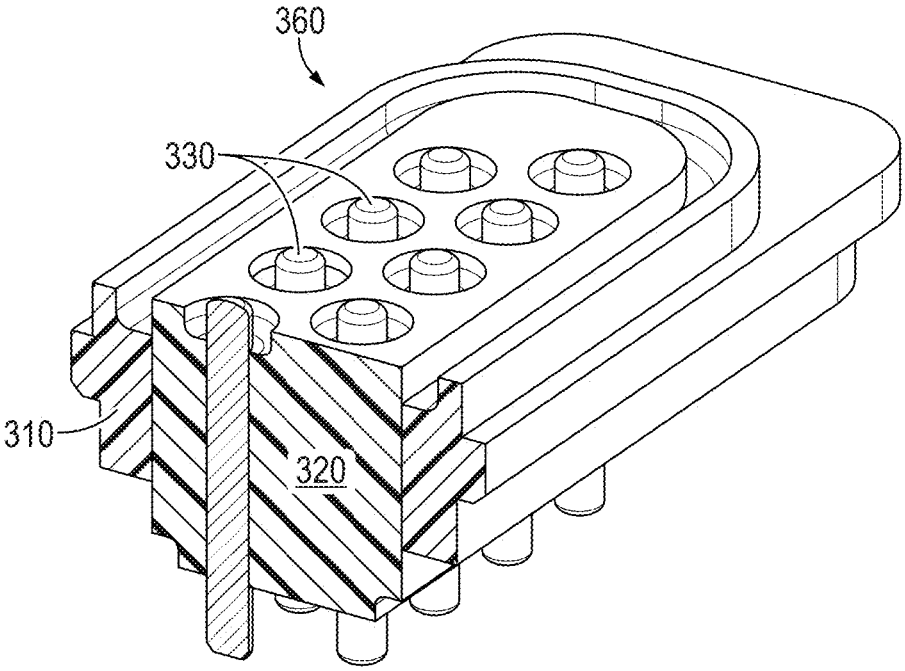
Figure 3D:
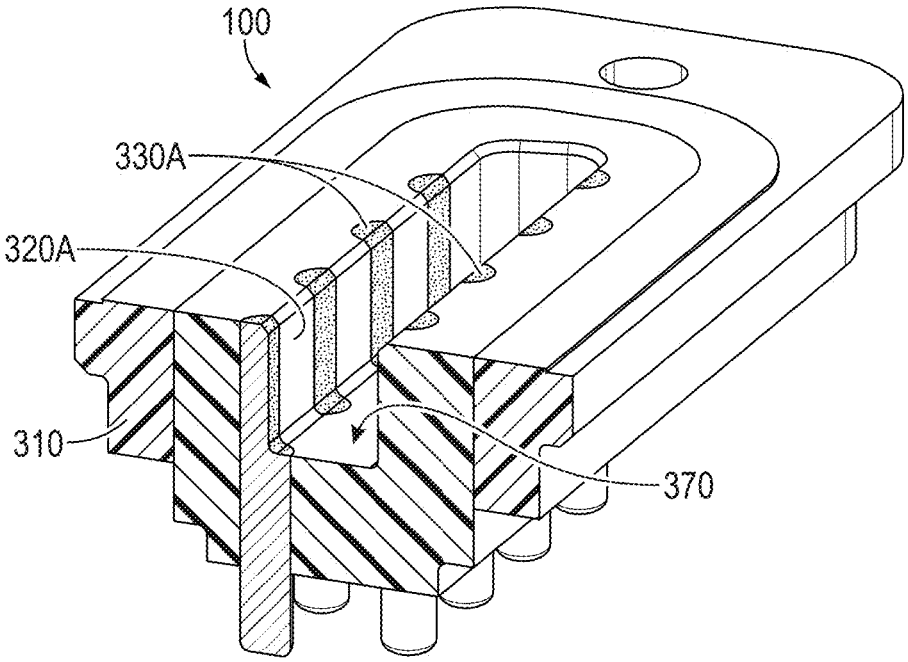

The fabrication sequence for manufacturing the edge-connect header 100 is illustrated in FIGS. 3A-3D. As shown in FIG. 3A, the shell 310, the core 320, and the individual electrical conductors 330 are formed to the desired dimensions and configuration. FIG. 3A also shows the braze filler preforms 340 used in the manufacturing process. FIG. 3B shows the pre-braze assembly 350 of the shell 310, the core 320, the individual electrical conductors 330, and the braze filler preforms 340. FIG. 3C shows a cross-section of the post-braze assembly 360 resulting from subjecting the pre-braze assembly 350 to a brazing process. FIG. 3D shows the completed edge-connect header 100 after the post-braze assembly 360 has been machined. As shown in FIG. 3D, the machining process forms a slot 370 in the core 320 and the electrical conductors 330 by removing a portion of the core 320 and a portion of each of the electrical conductors 330, thereby exposing a machined surface 320A of the core 320 and corresponding machined surfaces 330A of each of the electrical conductors 330. This machining process may be any subtractive process, for example, milling or drilling, whether with mechanical tooling or electrical or optical beams. The machining process may also include chemical etching or a water jet. In at least one embodiment of the present invention, the edge-connect header 100 undergoes an additional manufacturing step. During this additional manufacturing step, a wear- and corrosion-tolerant electrically conducting layer (not shown), is formed on the machined surfaces 330A of the electrical conductors 330.

In a preferred embodiment of the present invention, the shell 110 is formed of a nickel-cobalt-iron alloy (example trade name includes Kovar®), the core 120 is formed of a ceramic, e.g., alumina ($Al_2O_3$) or silicon nitride (SiN), the electrical conductors 130 are formed of molybdenum (Mo) or tungsten (W), the braze filler 140 is formed of silver (Ag) or a copper-silver alloy (example trade name includes CuSiff), and the wear- and corrosion-tolerant electrically conducting layer is formed of a noble metal, e.g., rhodium (Rh), hard-gold (Au), or platinum-gold (PtAu). While these materials are preferred for the various elements, other materials may also be employed provided they are brazable and have similar coefficients of thermal expansion (CTE), where the CTE of the shell material is greater than the CTE of the core material, which is in turn greater than the CTE of the conductor material. Utilizing materials with such CTEs facilitate lower residual stress in the edge-connect header upon cool down from brazing and is generally compressive enough to prevent mechanical failure of the ceramic core or braze joints. For example, the shell 110 may be formed of 400-series stainless steel. The core 120 may be formed, for example, of yttria-stabilized zirconia (YSZ). For example, the electrical conductors 130 may be formed of platinum-nickel-rhenium (example trade name includes PE2072).

Figure 4A:
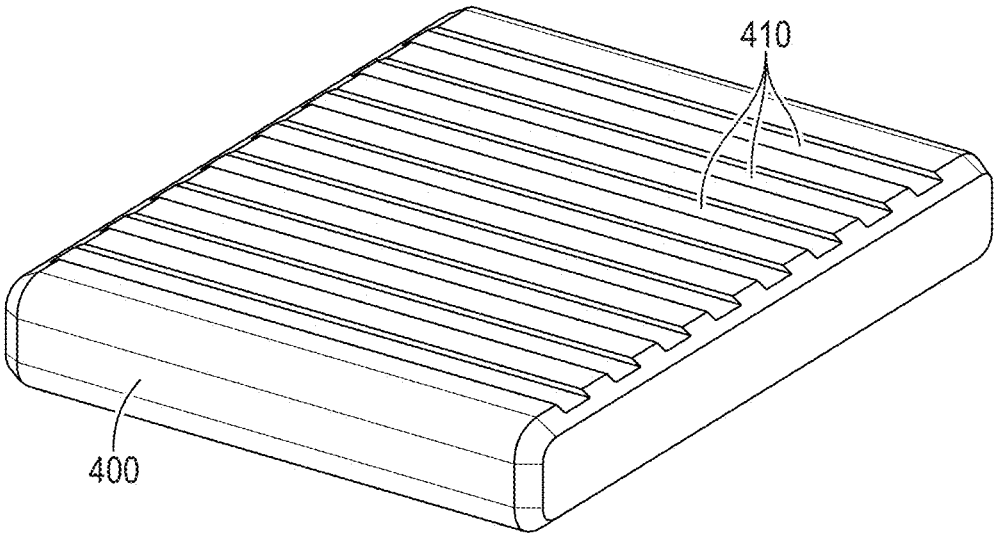
FIGS. 4A-4E illustrate the fabrication sequence for manufacturing a hermetic edge-connect header in accordance with at least one other embodiment of the present invention.
Figure 4B:
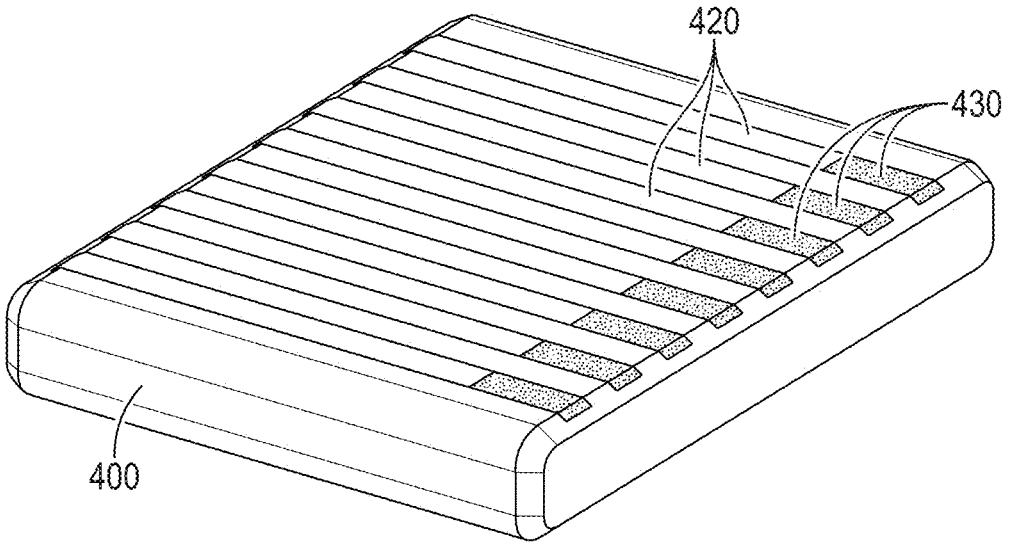
Figure 4C:
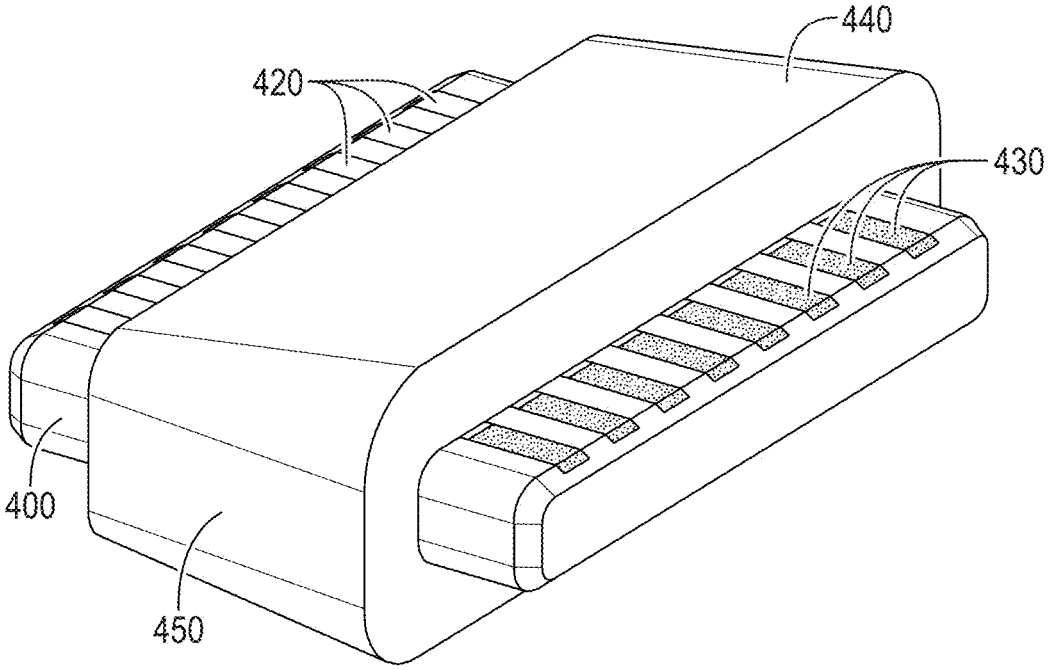
Figure 4D:
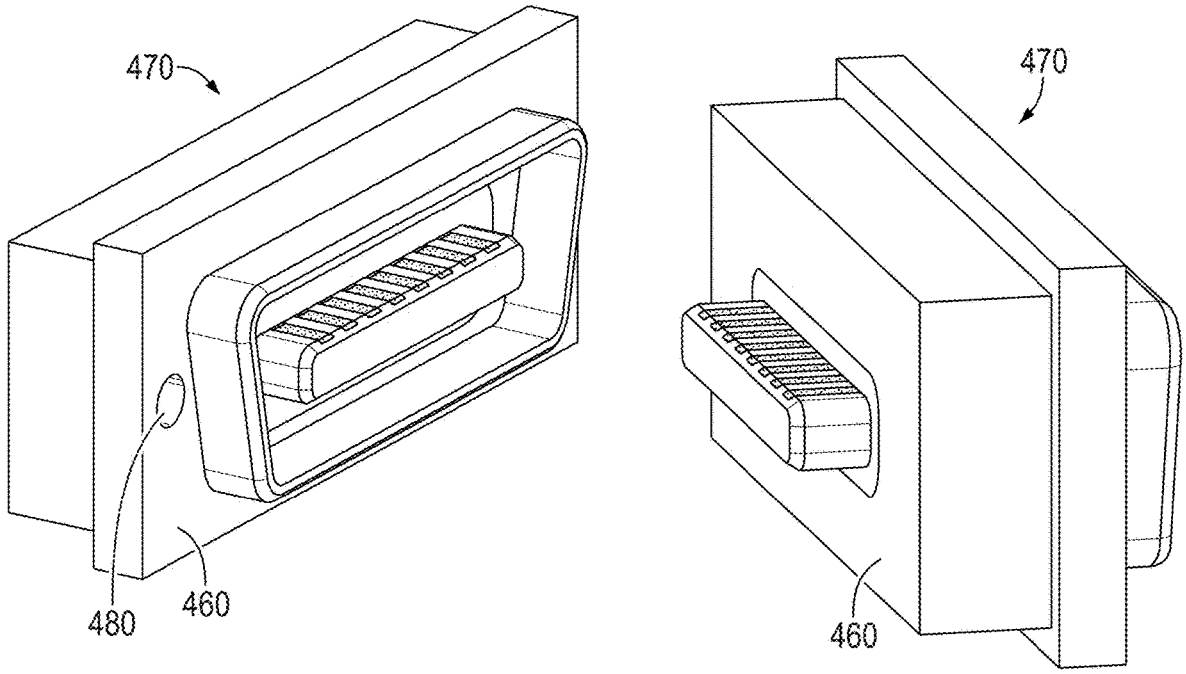
Figure 4E:
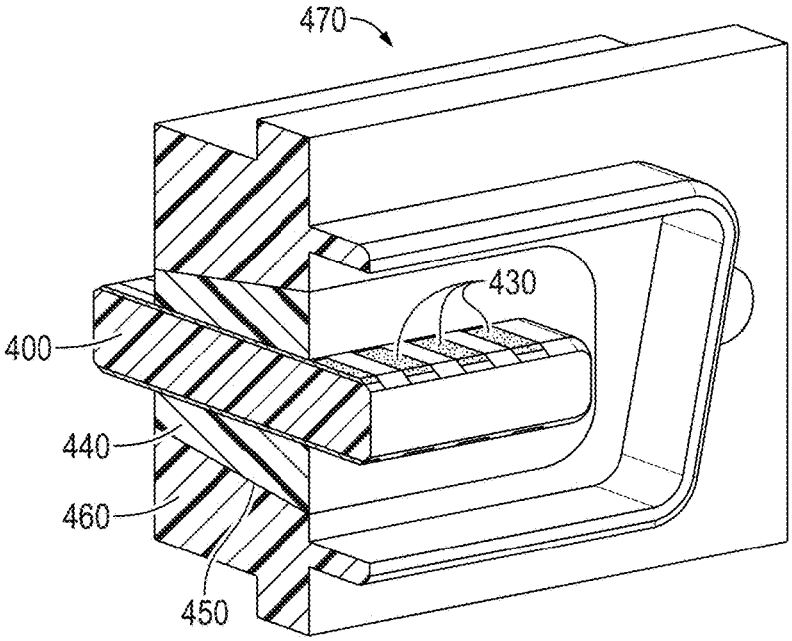

FIGS. 4A-4E illustrate an alternative fabrication sequence for manufacturing the hermetic edge-connect header 200 using a combination of additive and subtractive manufacturing. As shown in FIG. 4A, a conductor-lead blank 400 has a series of grooves 410 machined in the top surface thereof, with additional grooves machined in the bottom surface thereof (not shown). The conductor-lead blank 400, in various embodiments of the present invention, may be formed of alumina, YSZ, or silicon nitride. As shown in FIG. 4B, the grooves 410 are then filled with a conductor to form traces 420. The traces 420, in various embodiments of the present invention, may be formed of a braze with molybdenum (Mo) or tungsten (W) or an electroplating of copper (Cu) or nickel (Ni). To ensure proper tolerances, the structure comprising the lead blank 400 and the traces 420 may be polished flat. The traces 420 may optionally include a wear- and corrosion-tolerant electrically conducting layer 430, for example, a hard-gold layer. FIG. 4C shows a collar 440 located around the lead blank 400 and the traces 420. The collar 440, in various embodiments of the present invention, may be formed through additive and subtractive processes from alumina, YSZ, silicon nitride, or other hermetic-capable ceramic. A braze filler layer 450, formed for example of a copper-silver alloy, is applied to the outer surface of the collar 440. This structure is then inserted into a shell 460, formed for example of Kovar®, and subjected to a heat treatment to wet and seal the parts together, thereby ensuring hermeticity. The resultant edge-connect header 470 is shown in FIG. 4D (front and back) and FIG. 4E (cross-section) with blind-hole threaded fastener holes 480 in the shell 460 for attachment of a corresponding connector (not shown).

Figure 5A:
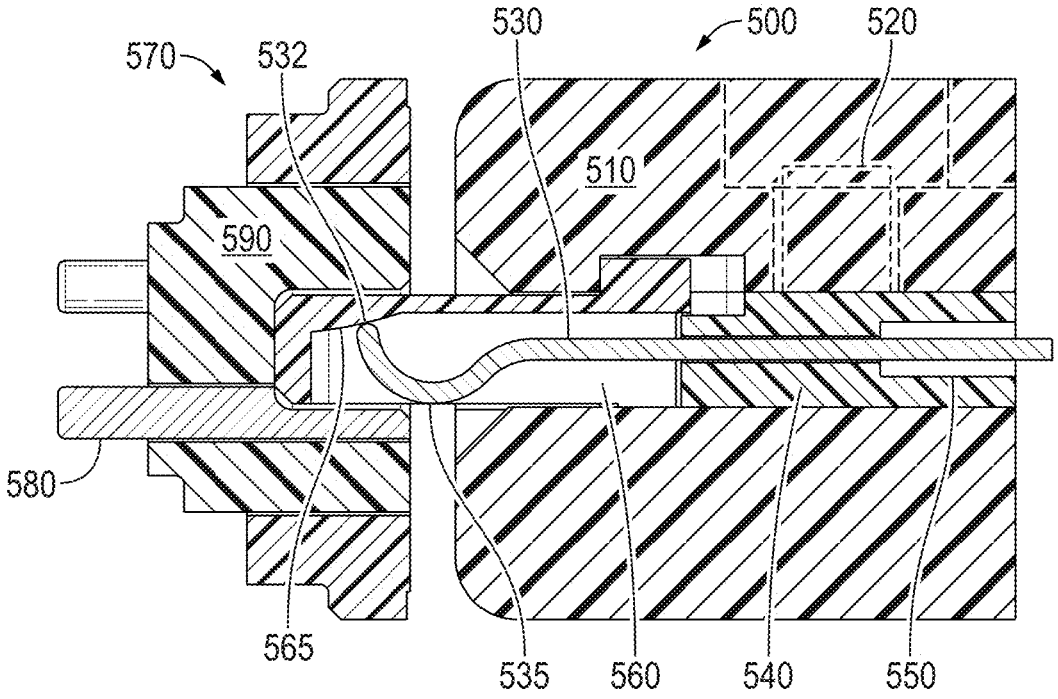
FIGS. 5A-5C illustrate a connector in accordance with one or more embodiments of the present invention.
Figure 5B:
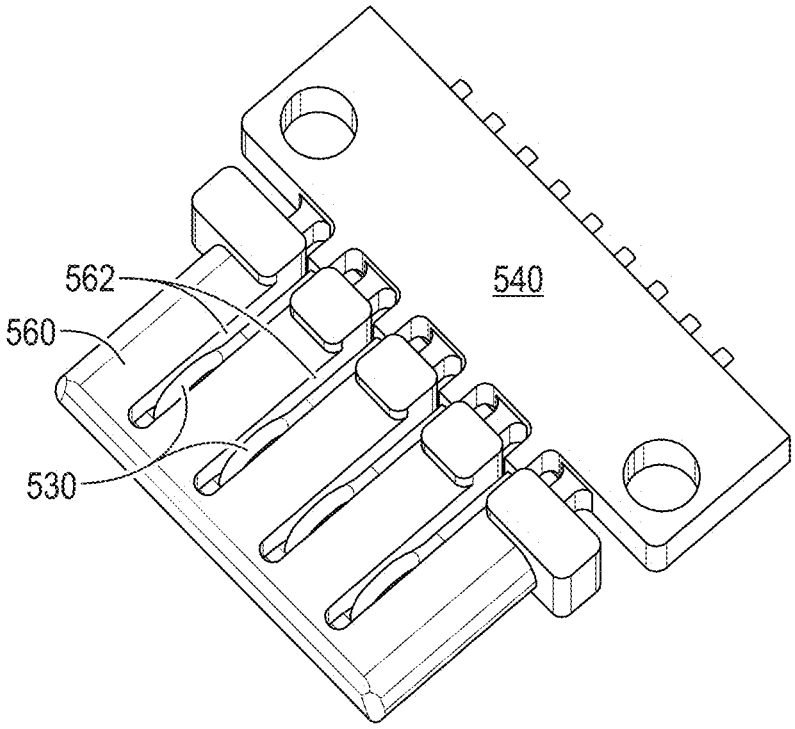

A connector 500 in accordance with at least one embodiment of the present invention is illustrated in FIGS. 5A and 5B. The connector 500 includes a shell 510 with two or more screw recesses 520 for assembling the connector 500. A tab washer (not shown) may be used in some embodiments of the present invention to prevent a corresponding retaining screw (not shown) from backing out of the screw recess 520, thereby ensuring that the connector 500 stays mated to its corresponding edge-connect header 570. The connector 500 further includes a plurality of wipers 530 mounted in a wiper housing 540 via respective holes in the wiper housing 540. The wiper housing 540 includes pockets 550 to permit making electrical connection to the wipers 530 and for holding potting compound to hold the wipers 530 in place. The wiper housing 540 is located at a fixed position within the shell 510. The connector 500 also includes a shuttle 560 for protecting the wipers 530 and for causing the wipers 530 to deflect during the process of mating the connector 500 to an edge-connect header 570. As shown in FIG. 5B, the shuttle 560 includes wiper slots 562 with one wiper slot 562 for each wiper 530. These wiper slots 562 ensure that the wipers 530 are electrically isolated from each other, but also help ensure that the wipers 530 deflect in only the correct direction, as will be explained below. As shown in FIG. 5B, the wiper housing 540 and the shuttle 560 have a linear shape.

In a preferred embodiment of the present invention, the shell 510 is formed of a structural insulating material, for example polyether ether ketone (PEEK); the wipers 530 are formed of a metallic spring material with high yield stress, for example beryllium copper, and may include a nickel phosphorus diffusion barrier and a wear- and corrosion-tolerant conducting layer, for example hard-gold; the wiper housing 540 and the shuttle 560 are formed of a structural insulating material, for example, PEEK. While these materials are preferred for the various elements, other materials may also be employed. For example, the shell 510 may be formed of polyamide-imide (example trade name includes Torlon®), polyimide (example trade name includes Vespel®), or polyetherimide (example trade name includes Ultem®). If the shell 510 is formed of a ceramic, then threaded inserts (not shown) should be used for the threads 520 due to increased stress and possible cracking if the shell 510 is made entirely of a ceramic. In other embodiments of the present invention requiring a more mechanically robust shell 510, the shell 510 may be formed of stainless steel or aluminum. The wipers 530 may, for example, be formed of beryllium-copper (BeCu), platinum-nickel-rhenium, palladium-silver-gold-platinum (example trade name includes Paliney 7), or gold-platinum-silver-copper (example trade name includes Neyoro G). For example, the wiper housing 540 and the shuttle 560 may be formed of polyamide-imide, polyimide, polyetherimide, alumina, or YSZ.

The process of mating the connector 500 to the edge-connect header 570 involves two steps. During the first step, illustrated in FIG. 5A, the connector 500 is inserted into the edge-connect header 570 until the shuttle 560 bottoms out in the slot of the header 570. As shown in FIG. 5A, there is a gap between the shell 510 and the edge-connect header 570. A spring (not shown) or the wipers 530 may be used to ensure that the shuttle 560 is in its extended position during the first step. During the second step, illustrated in FIG. 5C, the shell 510 slides further forward, thereby compressing the spring and causing the shuttle 560 to partially retract into the shell 510, until the shell 510 contacts the edge-connect header 570. This additional travel during the second step causes the wipers 530 to be deflected such that they make electrical contact with their corresponding electrical conductors 580 in the edge-connect header 570. Tips 532 of the wipers 530 cause this deflection of the wipers 530 by sliding across corresponding engagement profiles 565 of the shuttle 560. In particular, as the tips 532 slide across the corresponding engagement profiles 565 of the shuttle 560, the contact portions 535 of the wipers 530 extend out of the shuttle 560 until the contact portions 535 make physical and electrical contact with the faces of their corresponding electrical conductors 580. The wipers 530 extend out of the shuttle 560 in a direction orthogonal to the direction of the shuttle 560 when it partially retracts into the shell 510, i.e., in a direction orthogonal to the direction of the motion of the connector 500 when mating with the edge-connect header 570. To reduce friction and thus wear of the tips 532 and the engagement profiles 565, the tips 532 are preferably rounded to follow the engagement profiles 565 more smoothly. While the contact portions 535 of the wipers 530 illustrated in FIGS. 5A and 5B are curved, the contact portions 535 of the wipers 530 in other embodiments of the present invention have a flat cross-section, allowing for a larger, i.e., broader, contact patch between the contact portions 535 of the wipers 530 and the faces of their corresponding electrical conductors 580 in the edge-connect header 570.

The design of connector 500 provides several benefits. Because the wipers 530 of the connector 500 do not slide against their corresponding electrical conductors 580 in the edge-connect header 570, or against the core 590 of the header 570, there is no transfer of material between the wipers 530 of the connector 500 and the core 590 of the header 570. Thus, no path for potentially creating an electrical short is formed during mating/de-mating. For this same reason, any coating on the surface of the wipers 530 of the connector 500 or the electrical conductors 580 of the edge-connect header 570 undergoes minimal degradation during mating or de-mating, thereby allowing more mating/de-mating cycles. Further, as each of the wipers 530 are located in a corresponding wiper slot 562, it is not possible to form an electrical short between the wipers 530. Once the connector 500 has been mated to the edge-connect header 570, the wipers 530 of the connector 500 are loaded against their corresponding electrical conductors 580 in the header 570, thereby providing a robust electrical connection, even in high vibration environments.

Figure 5C:
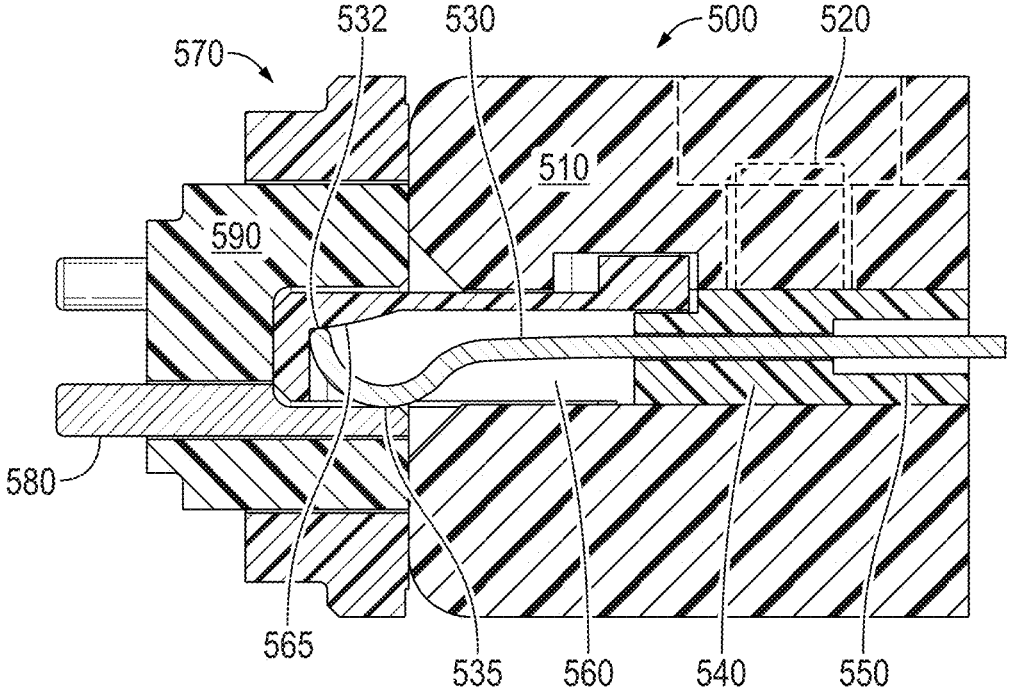
Figure 5D:
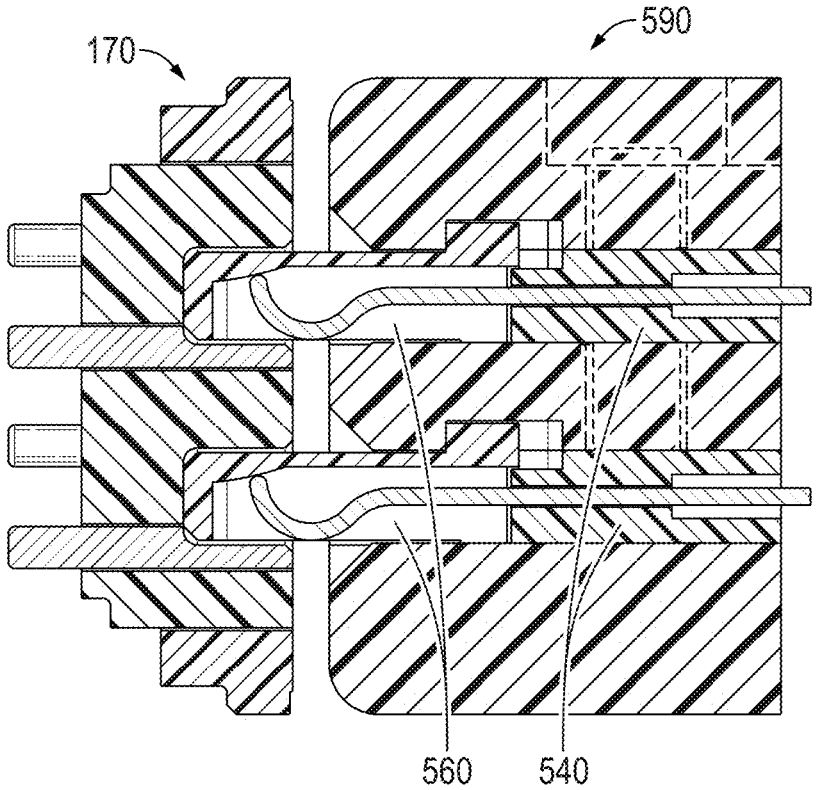
FIG. 5D illustrates an alternative connector in accordance with one or more embodiments of the present invention.

While the connector 500 shown in FIGS. 5A-5C has a single wiper housing 540 and a single shuttle 560, in other embodiments of the present invention, such as that shown in FIG. 5D, the connector 580 may have more than one wiper housing 540 and more than one shuttle 560. A connector 590 having this configuration would be needed for mating to an edge-connect header 170 such as that shown in FIG. 1C. Further, while the connector 500, 590 is compatible with a corresponding edge-connect header 100, 170 having one or more linear slots, in other embodiments of the present invention, the connector 500, 590, and its corresponding wiper housing 540 and shuttle 560, is compatible with a corresponding edge-connect header 200, 280 having one or more ring-shaped slots 260, i.e., the wiper housing(s) 540 and shuttle(s) 560 likewise have a corresponding ring shape.

In applications employing a connector 500, 590 for use with a corresponding edge-connect header 200, 280 having one or more ring-shaped slots 260, the connector 500, 590 may have a set of pins 530 for mating to a corresponding set of electrical conductors 230 located around the perimeter of the boss 270, i.e., around the inner perimeter of the ring-shaped slot 260. In other embodiments of the present invention, the connector 500, 590 may have a set of pins 530 for mating to a corresponding set of electrical conductors 230 located around the outer perimeter of the ring-shaped slot 260. In still other embodiments of the present invention, the connector 500, 590 may have a first set of pins 530 for mating to a corresponding first set of electrical conductors 230 located around the perimeter of the boss 270, i.e., around the inner perimeter of the ring-shaped slot 260, and a second set of the pins 530 for mating to a corresponding second set of electrical conductors 230 located around the outer perimeter of the ring-shaped slot 260.

In applications employing a connector 500, 590 for use with a corresponding edge-connect header 200, 280 having one or more U-shaped slots 260, the connector 500, 590 will likewise require the wiper housing(s) 540 and shuttle(s) 560 to have a corresponding U shape. In applications employing a connector 500, 590 for use with a corresponding edge-connect header having one or more arc-shaped or circular ring-shaped slots, the connector 500, 590 will likewise require the wiper housing(s) 540 and shuttle(s) 560 to have a corresponding arc or circular ring shape.

Further, in some embodiments of the present invention, the wipers 530 may be located around just the inner perimeter (or outer perimeter) of the U-shaped wiper housing(s) 540 and shuttle(s) 560. In other embodiments of the present invention, a first set of the wipers 530 are located around the inner perimeter of the U-shaped wiper housing(s) 540 and shuttle(s) 560, while a second set of the wipers 530 are located around the outer perimeter of the U-shaped wiper housing(s) 540 and shuttle(s) 560. As will be appreciated, a connector may include a combination of one or more linear wiper housing(s) 540 and shuttle(s) 560, one or more ring-shaped wiper housing(s) 540 and shuttle(s) 560, and/or one or more U-shaped wiper housing(s) 540 and shuttle(s) 560.

In accordance with yet another embodiment of the present invention, the connector 500 illustrated in FIGS. 5A-5C may include a socket (not shown) for attaching a multi-conductor ribbon cable. The socket serves to electrically connect the multi-conductor ribbon cable to the wipers 530, and to physically connect the ribbon cable to either the wiper housing 540 or the shell 510.

While the embodiment of the connector 500 illustrated in FIGS. 5A-5D includes a retractable shuttle 560, other embodiments of the present invention include a fixed shuttle 560 but include wipers 530 whose tips 532 extend beyond the face, i.e., end, of the shuttle 560 prior to mating with the edge-connect header 570. During the mating process with these embodiments, the tips 532, upon making contact with the core 590 of the header 570, retract into the face of the shuttle 560. This retraction of the tips 532 causes the wipers 530 to deflect due to the movement of the wipers 530 against corresponding engagement profiles 565 such that the contact portions 535 of the wipers 530 make electrical contact with their corresponding electrical conductors 580 in the header 570. As with the connector 500 illustrated in FIGS. 5A-5D, the contact portions 535 of the wipers 530 in the fixed shuttle embodiments extend out of the shuttle 560 in a direction orthogonal to the direction of the motion of the connector 500 when mating with the edge-connect header 570. These fixed shuttle embodiments of the present invention provide many of the same benefits as the retractable shuttle embodiments of the present invention.

Figure 6A:
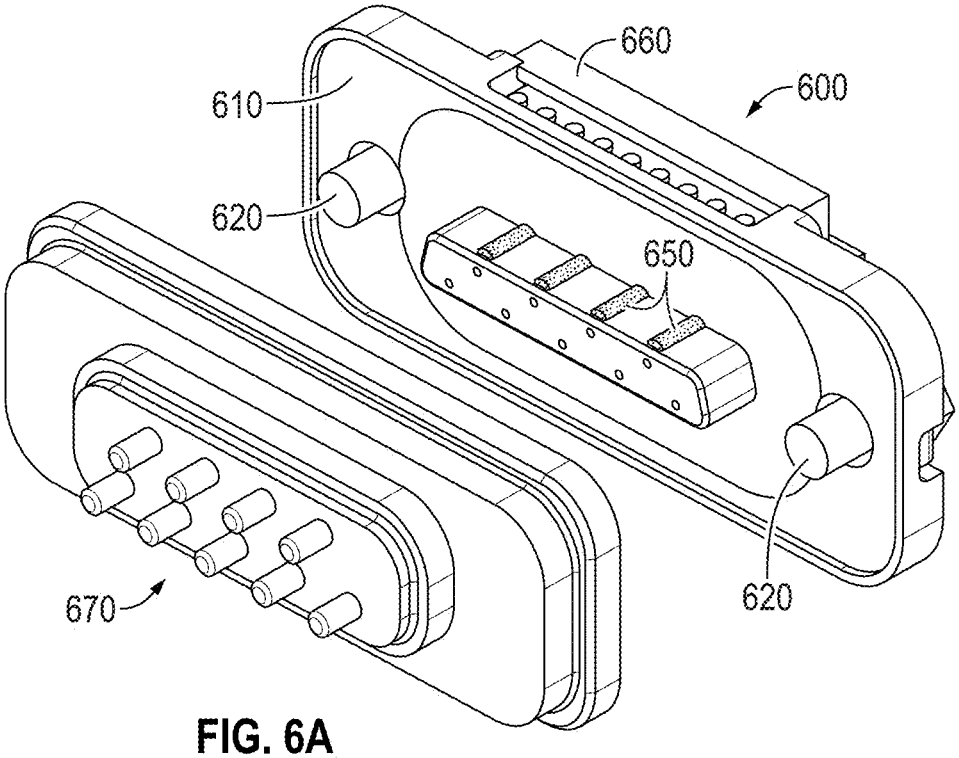
FIGS. 6A-6F illustrate a connector in accordance with at least one other embodiment of the present invention.
Figure 6B:
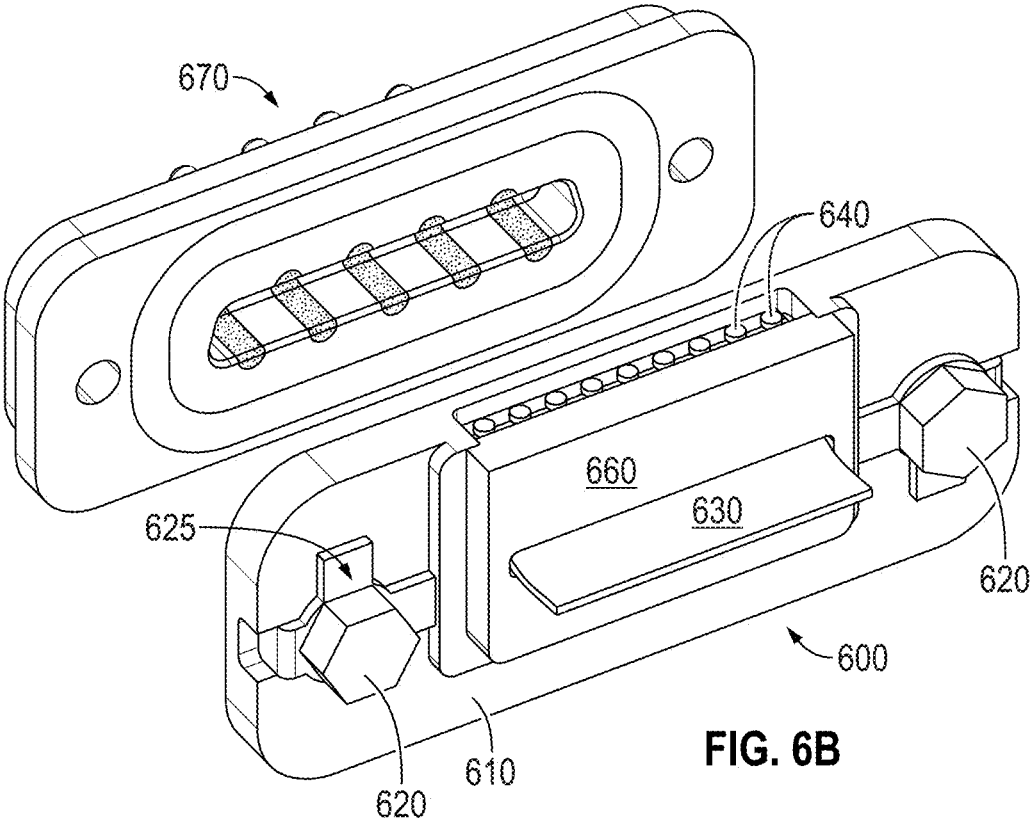
Figure 6C:
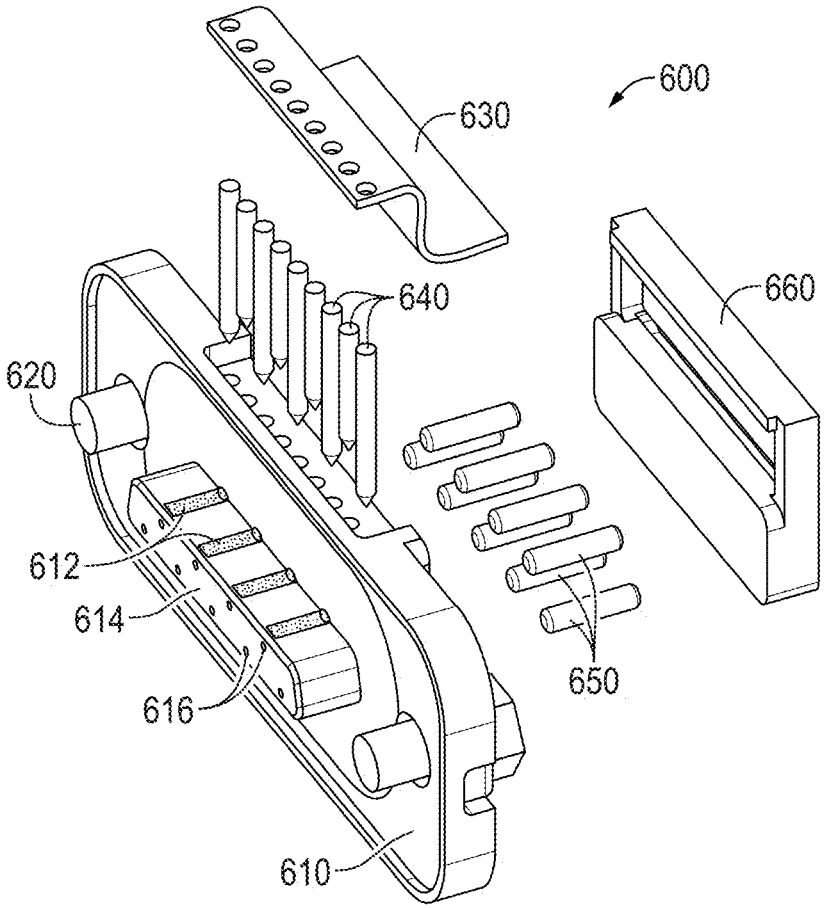
Figure 6D:
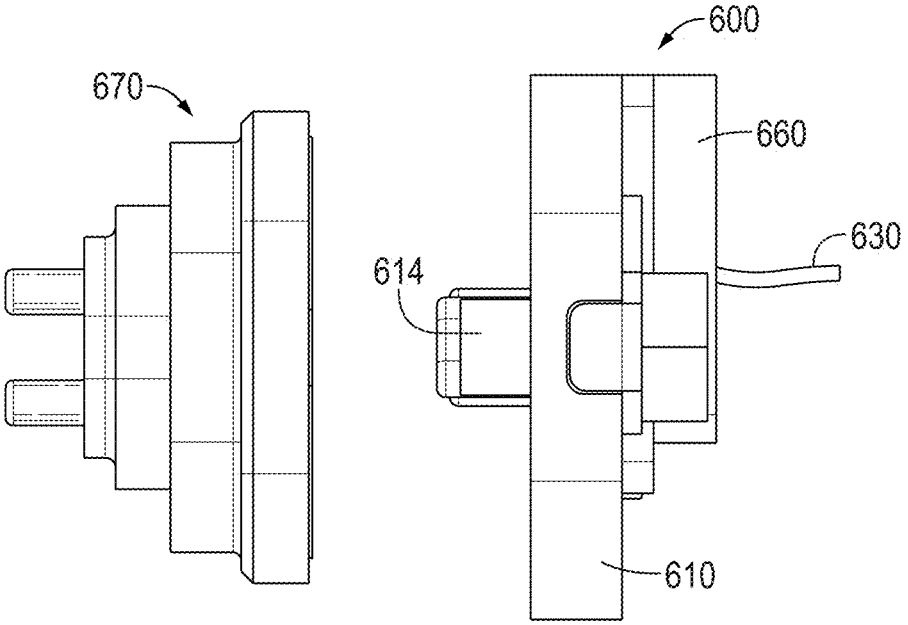

A low-profile connector 600, in accordance with yet another embodiment of the present invention, is illustrated in FIGS. 6A-6D. The connector 600 includes a face plate 610 with two retaining screws 620 for attaching the connector 600 to its corresponding edge-connect header 670. Tab washers 625, which are bent against a flat of the retaining screws 620, are used to prevent the retaining screws 620 from backing out, thereby ensuring that the connector 600 stays mated to its corresponding edge-connect header 670. The connector further includes a multi-conductor ribbon cable 630 that makes electrical contact to a plurality of pins 640. The plurality of pins 640 make electrical contact to a plurality of wipers 650. A backing plate 660 is used to retain the multi-conductor ribbon cable 630, the plurality of pins 640, and the plurality of wipers 650 in the correct positions relative to the face plate 610. The backing plate 660 may also hold potting material for strain relief on the conductor ribbon cable 630. As shown in FIG. 6C, the plurality of wipers 650 are located in corresponding grooves 612 formed in a boss 614 of the face plate 610, with the boss 614 having a linear shape. The trapezoid-shaped ends of the boss 614 ensure mating to the edge-connect header 670 in only a single orientation, thereby ensuring that each of the plurality of wipers 650 of the low-profile connector 600 are in electrical contact with the correct corresponding electrical conductors 680 in the edge-connect header 670.

In certain embodiments of the present invention, the connector 600 includes solder joints (not shown) to ensure electrical contact between the multi-conductor ribbon cable 630 and the plurality of pins 640. In certain other embodiments of the present invention, the connector 600 includes solder joints (not shown) to ensure electrical contact between the plurality of pins 640 and the plurality of wipers 650. In yet other embodiments of the present invention, the boss 614 of the face plate 610 includes epoxy injection ports 616 to ensure the plurality of wipers 650 remain captured inside the grooves 612. In still other embodiments of the present invention, the plurality of wipers 650 may remained captured in the grooves 612 by retaining the plurality of wipers 650 using bores (not shown) in the portion of the faceplate 610 adjacent the grooves 612, or by electroplating the plurality of wipers 650 to the grooves 612.

Figure 6E:
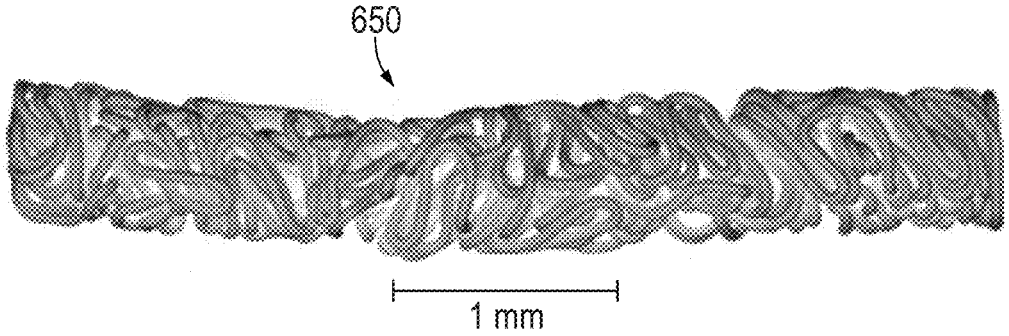

In a preferred embodiment of the present invention, the face plate 610 and backing plate 660 are formed of PEEK and the plurality of pins 640 are formed of copper with a diffusion barrier and gold plating. The plurality of wipers 650 are formed of a fine beryllium-copper wire, optionally covered with a hard-gold layer, that effectively forms a low-mass, compliant metal wool (example trade name includes Fuzz Button®), a close-up of which is shown in FIG. 6E. While these materials are preferred for the various elements, other materials may also be employed. For example, the face plate 610 and backing plate 660 may be formed of polyamide-imide, polyimide, polyetherimide, alumina, or YSZ. The plurality of pins 640 may, for example, be formed of gold-plated brass, gold-plated nickel, platinum-nickel-rhenium, palladium-silver-gold-platinum, or gold-platinum-silver-copper. For example, the plurality of wipers 650 may be formed of a beryllium-copper, molybdenum, tungsten, or nickel-chromium low-mass, compliant metal wool with an optional gold-plating.

Figure 6F:
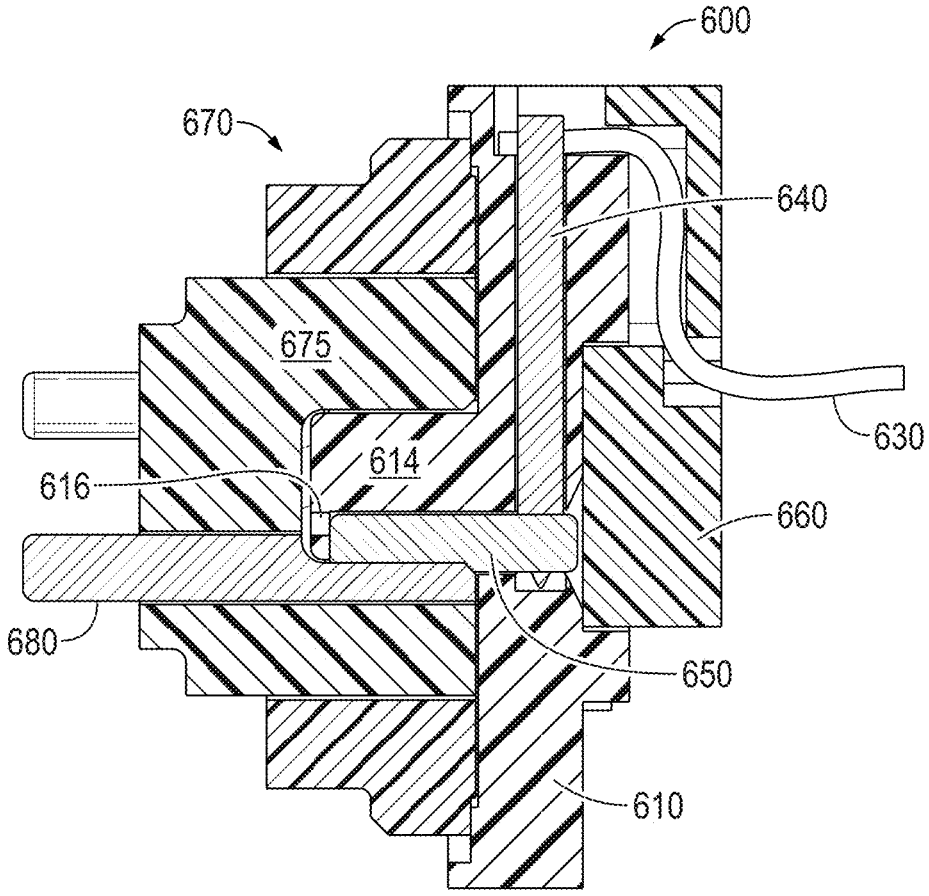

Unlike the two-step process of mating the connector 500 to the edge-connect header 570, the process of mating the connector 600 to an edge-connect header 670 involves only a single step. During the step, illustrated in FIG. 6F, the connector 600 is inserted into the edge-connect header 670 until the face plate 610 is flush with the face of the core 675 of the edge-connect header 670. Once assembled, the boss 614 will have a slight clearance with the bottom of the slot of the header 670. During this step, the plurality of wipers 650 slide across and make physical and electrical contact with the faces of the corresponding electrical conductors 680 in the edge-connect header 670. Due to the nature of the plurality of wipers 650, i.e., that they are formed of a low-mass, compliant metal wool, each of the plurality of wipers 650 has multiple points of contact with the corresponding electrical conductors 680. These multiple points of contact for each of the second plurality of wipers 650 provide a robust electrical connection and the low mass of the compliant metal wool reduces electrical chatter, even in high vibration environments.

Figure 6G:
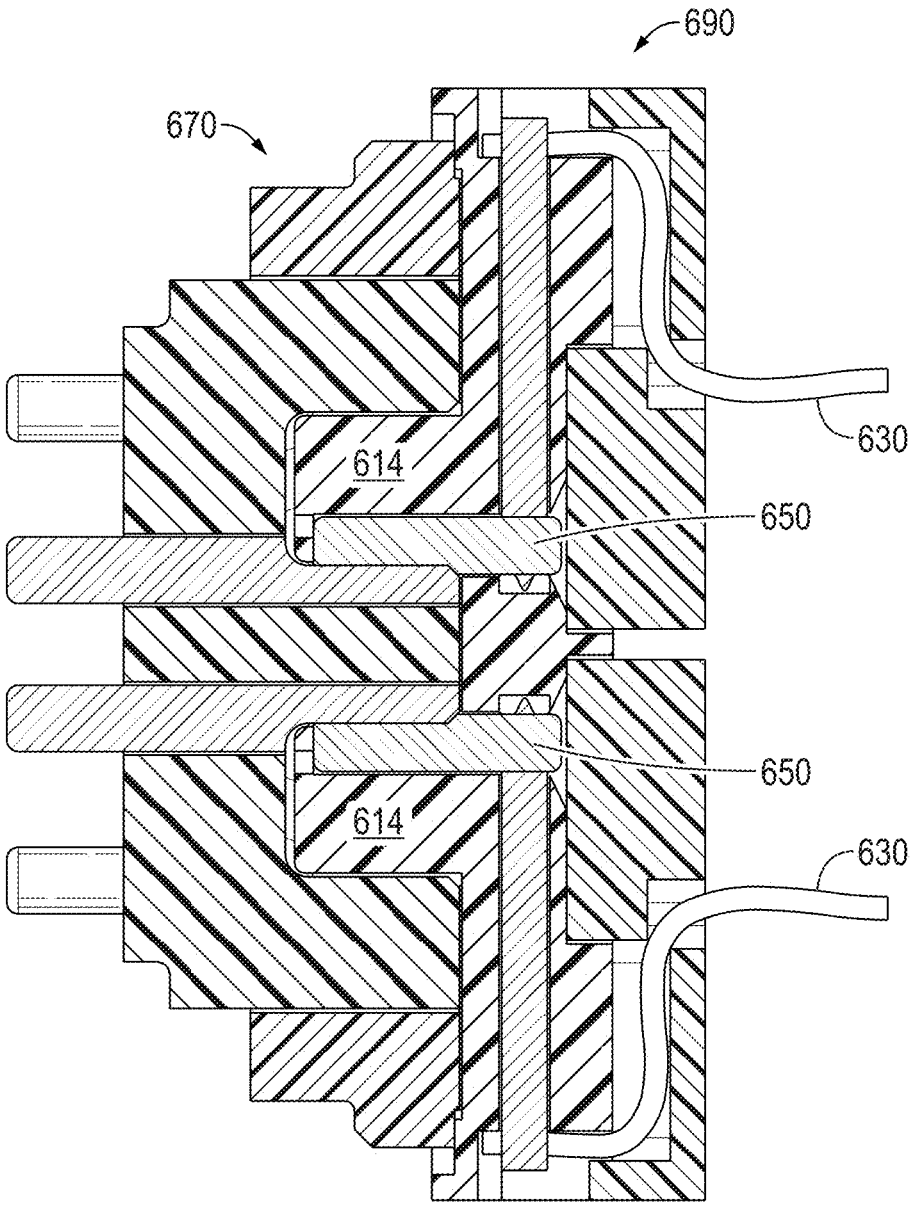
FIG. 6G illustrates an alternative connector in accordance with one or more embodiments of the present invention.

While the connector 600 shown in FIGS. 6A-6F has a faceplate 610 with a single boss 614 and corresponding plurality of wipers 650, in other embodiments of the present invention, such as that shown in FIG. 6G, the connector 690 may have more than one boss 614 and more than one corresponding set of the plurality of wipers 650. A connector 690 having this configuration would be needed for mating to an edge-connector header 170 such as that shown in FIG. 1C. As will be appreciated by one of ordinary skill in the art, while the connector 690 is illustrated with two multi-conductor ribbon cables 630, other embodiments of the present invention may employ a single ribbon cable 630. Further, while the connector 600, 690 is compatible with a corresponding edge-connect header 100, 170 having one or more linear slots, in other embodiments of the present invention, the connector 600, 690, and its corresponding faceplate 610 and boss(es) 614, is compatible with a corresponding edge-connect header 200, 280 having one or more ring-shaped slots 260, i.e., the boss(es) 614 likewise have a corresponding ring shape.

In applications employing a connector 600, 690 for use with a corresponding edge-connect header 200, 280 having one or more ring-shaped slots 260, the connector 600, 690 may have a set of the plurality of wipers 650 for mating to a corresponding set of electrical conductors 230 located around the perimeter of the boss 270, i.e., around the inner perimeter of the ring-shaped slot 260. In other embodiments of the present invention, the connector 600, 690 may have a set of the plurality of wipers 650 for mating to a corresponding set of electrical conductors 230 located around the outer perimeter of the ring-shaped slot 260. In yet other embodiments of the present invention, the connector 600, 690 may have a first set of the plurality of wipers 650 for mating to a corresponding first set of electrical conductors 230 located around the perimeter of the boss 270, i.e., around the inner perimeter of the ring-shaped slot 260, and a second set of the plurality of wipers 650 for mating to a corresponding second set of electrical conductors 230 located around the outer perimeter of the ring-shaped slot 260.

In applications employing a connector 600, 690 for use with a corresponding edge-connect header having one or more curved slots forming arc-shaped slots 260, the connector 600, 690 will likewise require the boss(es) 614 of the face plate 610 to have a corresponding arc shape. Further, in some embodiments of the present invention, the plurality of wipers 650 may be located around just the inner perimeter (or outer perimeter) of the arc-shaped boss(es) 614 of the face plate 610. In other embodiments of the present invention, a first set of the plurality of wipers 650 are located around the inner perimeter of the arc-shaped boss(es) 614 of the face plate 610, while a second set of the plurality of wipers 650 are located around the outer perimeter of the arc-shaped boss(es) 614 of the face plate 610.

In applications employing a connector 600, 690 for use with a corresponding edge-connect header having one or more round ring-shaped slots 260, the connector 600, 690 will likewise require the boss(es) 614 of the face plate 610 to have a corresponding round shape. Further, in some embodiments of the present invention, the plurality of wipers 650 may be located around just the inner perimeter (or outer perimeter) of the round-shaped boss(es) 614 of the face plate 610. In other embodiments of the present invention, a first set of the plurality of wipers 650 are located around the inner perimeter of the round-shaped boss(es) 614 of the face plate 610, while a second set of the plurality of wipers 650 are located around the outer perimeter of the round-shaped boss(es) 614 of the face plate 610.

In applications employing a connector 600, 690 for use with a corresponding edge-connect header 200, 280 having one or more U-shaped slots 260, the connector 600, 690 will likewise require the boss(es) 614 of the face plate 610 to have a corresponding U shape. Further, in some embodiments of the present invention, the plurality of wipers 650 may be located around just the inner perimeter (or outer perimeter) of the U-shaped boss(es) 614 of the face plate 610. In other embodiments of the present invention, a first set of the plurality of wipers 650 are located around the inner perimeter of the U-shaped boss(es) 614 of the face plate 610, while a second set of the plurality of wipers 650 are located around the outer perimeter of the U-shaped boss(es) 614 of the face plate 610. As will be appreciated, a connector may include a combination of one or more linear boss(es) 614, one or more ring-shaped boss(es) 614, one or more arc-shaped boss(es) 614, one or more round-shaped boss(es) 614, and/or one or more U-shaped boss(es) 614.

In accordance with yet another embodiment of the present invention, the low-profile connector 600 illustrated in FIGS. 6A-6D may include a socket (not shown) for attaching the multi-conductor ribbon cable 630, i.e., the ribbon cable 630 is not integral to the connector 600. The socket serves to electrically connect the non-integral multi-conductor ribbon cable 630 to the plurality of pins 640, and to physically connect the non-integral ribbon cable 630 to either the face plate 610 or the backing plate 660.

In accordance with still other embodiments of the present invention, the low-profile connector 600 illustrated in FIGS. 6A-6D may employ a standard multi-conductor cable (not shown) with a ferrule to retain it as opposed to the illustrated multi-conductor ribbon cable 630. Similarly, some embodiments of the present invention may employ a socket (not shown) for attaching the standard multi-conductor cable (not shown), i.e., the standard multi-conductor cable (not shown) is not integral to the connector 600. The socket serves to electrically connect the standard non-integral multi-conductor cable to the plurality of pins 640, and to physically connect the standard non-integral multi-conductor cable 630 to either the face plate 610 or the backing plate 660.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An edge-connect header comprising:

a shell;

a core located within an opening in the shell;

a core braze filler located between the shell and the core, the core braze filler adapted to form a first hermetic seal;

a plurality of electrical conductors, each of the plurality of electrical conductors located within a corresponding one of a plurality of openings within the core, the plurality of electrical conductors includes a first set of the plurality of electrical conductors and a second set of the plurality of electrical conductors; and a plurality of electrical conductor braze fillers, each of the plurality of electrical conductor braze fillers located between a corresponding one of the plurality of electrical conductors and the core, the plurality of electrical conductor braze fillers adapted to form a corresponding second plurality of hermetic seals;

wherein the edge-connect header includes a slot, the slot exposing a machined surface of the core and a corresponding plurality of machined surfaces of the plurality of electrical conductors.

2. The edge-connect header of claim 1, wherein the slot is a linear slot, and wherein the first set of the plurality of electrical conductors are located adjacent a first side of the linear slot, and wherein the second set of the plurality of electrical conductors are located adjacent a second side of the linear slot facing the first side of the linear slot.

3. The edge-connect header of claim 1, wherein the slot is a ring-shaped slot, thereby forming a boss surrounded by the ring-shaped slot, and wherein the first set of the plurality of electrical conductors are located adjacent a first side of the boss, and wherein the second set of the plurality of electrical conductors are located adjacent a second side of the boss opposite the first side of the boss.

4. The edge-connect header of claim 1, wherein the slot is a ring-shaped slot, thereby forming a boss surrounded by the ring-shaped slot, wherein the first set of the plurality of electrical conductors are located adjacent an inner perimeter of the ring-shaped slot, and wherein the second set of the plurality of electrical conductors are located adjacent an outer perimeter of the ring-shaped slot.

5. The edge-connect header of claim 1, further comprising at least a second slot, the second slot exposing a second machined surface of the core and a corresponding second plurality of machined surfaces of the plurality of electrical conductors.

* * * * *